US008800152B2

(12) United States Patent
Werner

(10) Patent No.: US 8,800,152 B2
(45) Date of Patent: Aug. 12, 2014

(54) COMB ATTACHMENT HAVING ROUNDED TIP

(75) Inventor: Edwin A. Werner, Union Grove, WI (US)

(73) Assignee: Andis Company, Sturtevant, WI (US)

( * ) Notice: Subject to any disclaimer, the term of this patent is extended or adjusted under 35 U.S.C. 154(b) by 137 days.

(21) Appl. No.: 13/405,915

(22) Filed: Feb. 27, 2012

(65) Prior Publication Data

US 2013/0219723 A1 Aug. 29, 2013

(51) Int. Cl.
*B26B 19/20* (2006.01)

(52) U.S. Cl.
USPC ..... 30/200; 30/233.5; 30/201

(58) Field of Classification Search
USPC ..... 30/233.5, 200, 201, 233, 286
See application file for complete search history.

(56) References Cited

U.S. PATENT DOCUMENTS

| | | | | |
|---|---|---|---|---|
| 2,780,868 | A * | 2/1957 | Brown | 30/200 |
| 3,008,233 | A * | 11/1961 | Waggoner | 30/537 |
| 3,344,520 | A * | 10/1967 | Williams | 30/200 |
| 3,844,036 | A * | 10/1974 | Wahl et al. | 30/200 |
| 6,125,545 | A * | 10/2000 | Yamaguchi et al. | 30/233.5 |
| 6,279,234 | B1 * | 8/2001 | Chaouachi et al. | 30/201 |
| 7,073,262 | B2 * | 7/2006 | Melton | 30/233.5 |
| 2009/0019706 | A1 * | 1/2009 | Werner et al. | 30/233.5 |
| 2009/0113722 | A1 * | 5/2009 | Werner et al. | 30/200 |

* cited by examiner

*Primary Examiner* — Omar Flores Sanchez
(74) *Attorney, Agent, or Firm* — Michael Best & Friedrich LLP

(57) ABSTRACT

A comb attachment for use on a hair clipper includes tines that have rounded free ends positioned rearward of the cutting edge of a lower blade and forward of the cutting edge of the upper blade. Because of a radius of curvature of the rounded free ends, the free ends do not cross the cutting edge of the upper blade during attachment and removal of the comb attachment.

7 Claims, 9 Drawing Sheets

COMB ATTACHMENT HAVING ROUNDED TIP

BACKGROUND

The present invention relates to a comb attachment having tines with free ends, the free ends defining rounded tips.

SUMMARY

In one embodiment, the invention provides a comb assembly for a hair clipper having a lower blade and an upper blade reciprocating with respect to the lower blade, the lower blade having a lower cutting edge and the upper blade having an upper cutting edge, the upper cutting edge being parallel to and rearward of the lower cutting edge, the comb assembly comprising: a comb attachment comprising a body and a plurality of tines extending forward from the body; and an attachment mechanism for attaching the comb attachment to the lower blade; wherein each tine includes an extension portion extending along a bottom side of the lower blade; wherein each tine includes a hook portion curving from the extension portion across the lower cutting edge; wherein each hook portion includes a rounded free end adjacent a top surface of the lower blade rearward of the lower cutting edge and forward of the upper cutting edge, the rounded free end describing a radius of curvature; wherein the comb attachment is pivoted about the lower cutting edge during installation and removal of the comb attachment from the lower blade; and wherein the radius of curvature of the rounded free end of each hook portion is sized to avoid the free end from crossing the upper cutting edge as the comb attachment is pivoted on the lower cutting edge during installation and removal of the comb attachment.

In some embodiments, the attachment mechanism includes a magnet carried by the body, and engageable with the lower blade through a magnetic attraction.

In another aspect of the invention, the invention provides a hair clipper comprising: a prive mover; a lower blade having a lower cutting edge; an upper blade reciprocating with respect to the lower blade under the influence of the motor, the upper blade having an upper cutting edge that is parallel to and rearward of the lower cutting edge; a comb attachment comprising a body and a plurality of tines extending forward from the body; and an attachment mechanism for attaching the comb attachment to the lower blade; wherein each tine includes an extension portion extending along a bottom side of the lower blade; wherein each tine includes a hook portion curving from the extension portion across the lower cutting edge; wherein each hook portion includes a rounded free end adjacent a top surface of the lower blade rearward of the lower cutting edge and forward of the upper cutting edge, the rounded free end describing a radius of curvature; wherein the comb attachment is pivoted about the lower cutting edge during installation and removal of the comb attachment from the lower blade; and wherein the radius of curvature of the rounded free end of each hook portion is sized to avoid the free end from crossing the upper cutting edge as the comb attachment is pivoted on the lower cutting edge during installation and removal of the comb attachment.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
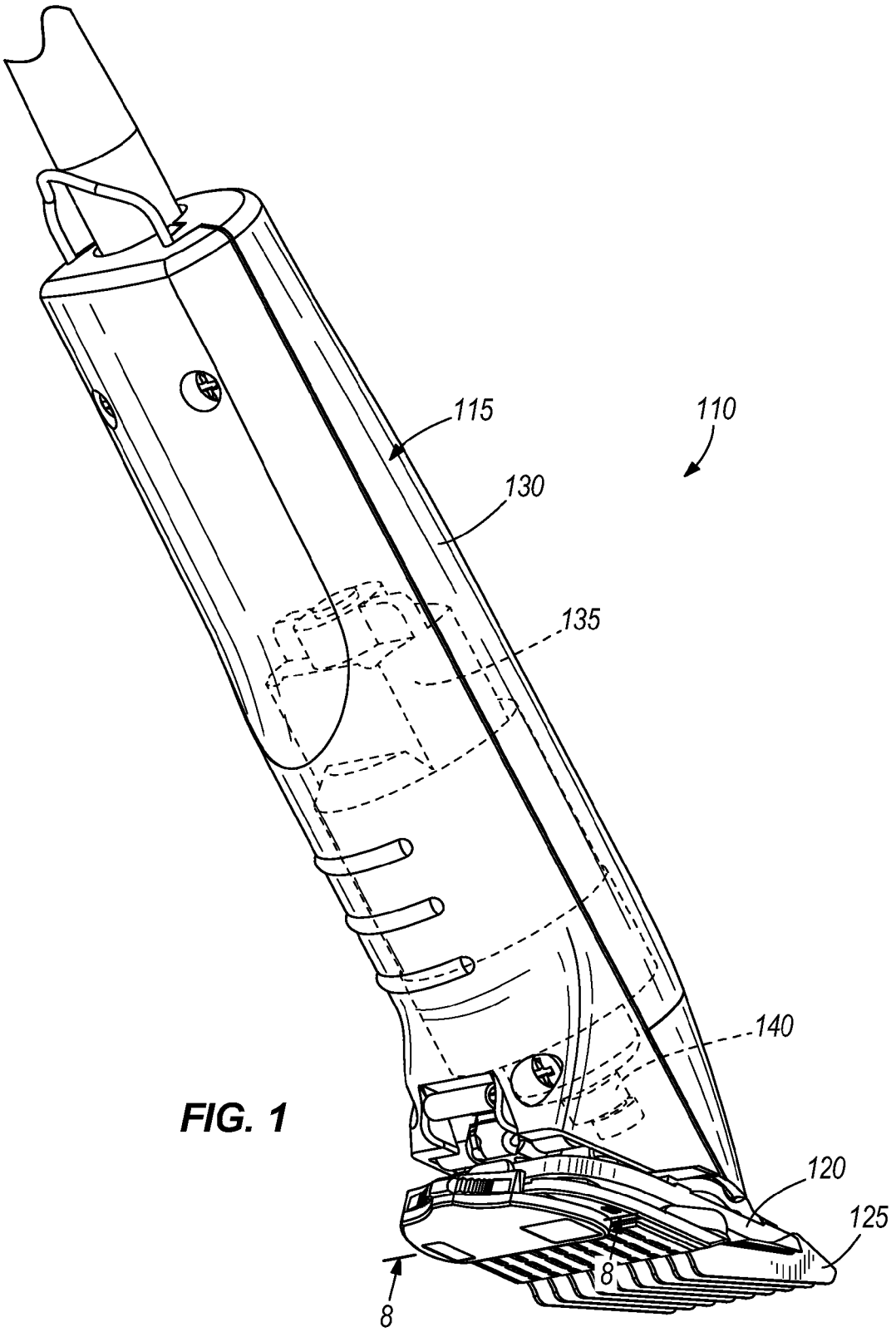
FIG. 1 is a perspective view of a clipper embodying the present invention.

FIG. 1 illustrates a clipper 110 embodying the present invention. The clipper 110 comprises a clipper body 115, a blade assembly 120, and a comb assembly 125.

The term "clipper" is used throughout this specification to mean a hair cutting implement that includes two blades, at least one of the blades being reciprocated with respect to the other blade under the influence of a prime mover. The term "clipper" includes trimmers and any other devices that meet the foregoing general definition. The term "prime mover" includes electric motors, magnetic drives, and pivot drives, the prime mover being operated by means of a power cord plugged into a power outlet or a battery or any other energy storage means.

Throughout this specification, all terms involving direction or relative position will be made with respect to the direction of movement of the blade assembly 120 and comb assembly 125 during a cutting operation. The clipper 110 is capable of trimming hair in any conceivable attitude, but the components of the clipper 110 remain interconnected in the same relative positions during operation, and the blade assembly 120 and comb assembly 125 are always moved in a single direction during cutting operations. For example, the term "front" means a portion closest to the leading edge of the blade assembly 120 and comb assembly 125, and the terms "forward" and "forwardly" refer to the direction of travel of the blade assembly 120 and comb assembly 125 during the cutting operation. The terms "rear," "rearward," and "rearwardly" mean the opposite side or direction of the terms "front," "forward," and "forwardly." Terms such as "up," "above," "top," "down," "below," "bottom" and variations on those root words will be from the perspective of the blade assembly 120 and comb assembly 125 during operation. The terms "right" and "left" will refer to such directions taken from the perspective looking forward along the top of the blade assembly 120.

With continued reference to FIG. 1, the clipper body 115 includes a housing 130 and a prime mover, which in the illustrated embodiment is a motor 135, in the housing 130. The motor 135 includes an output shaft 140 that rotates when the motor 135 is energized.

Figure 2:
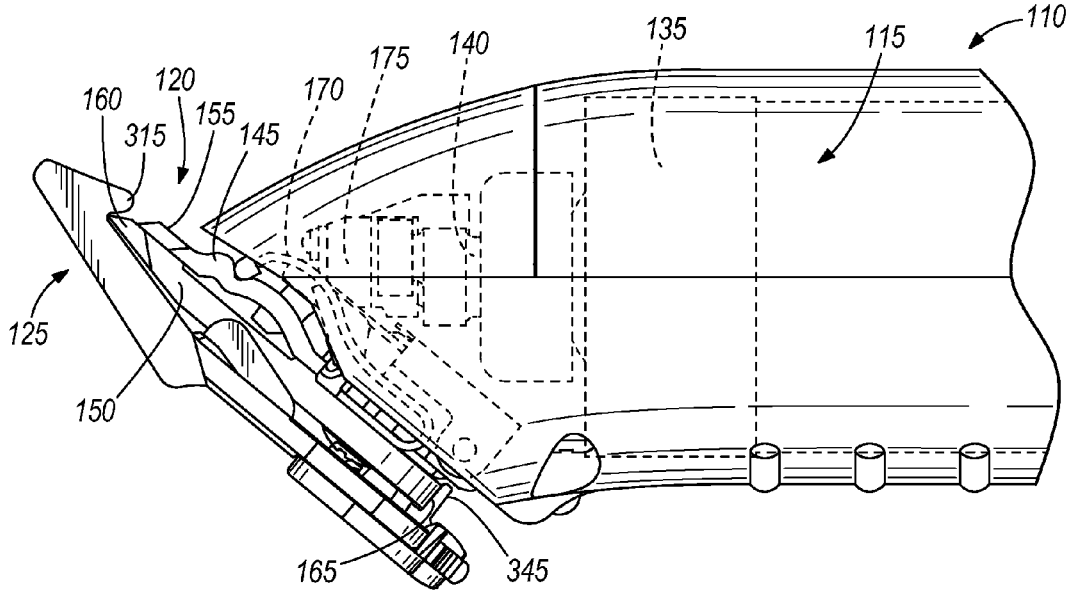
FIG. 2 is a side view of a comb assembly installed on a blade assembly of the clipper.
Figure 3:
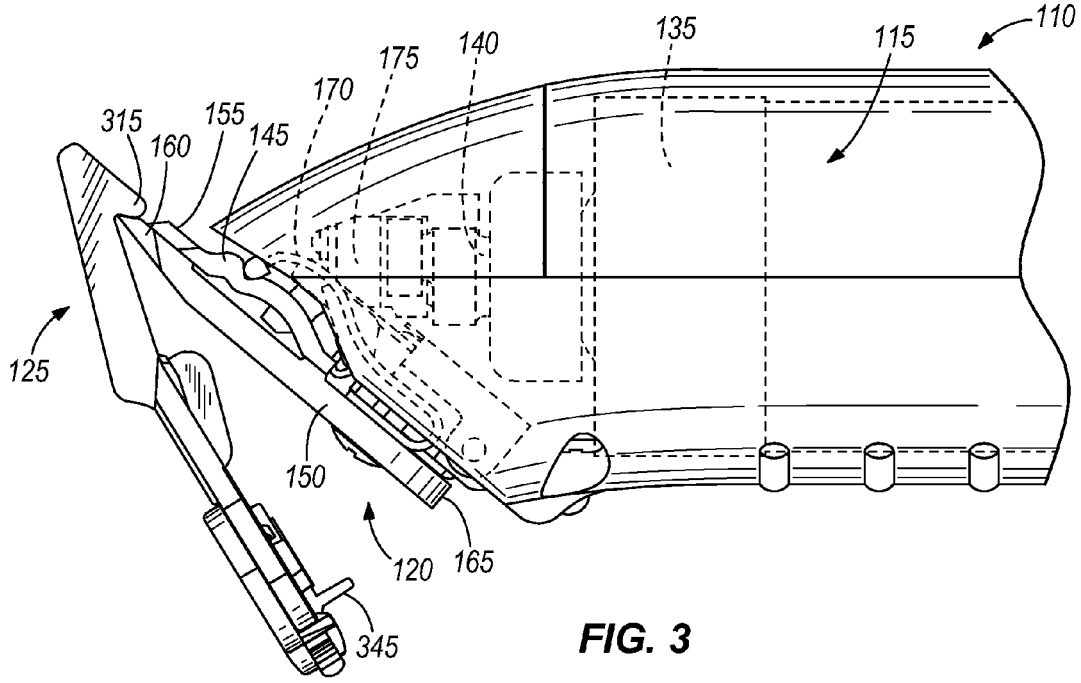
FIG. 3 is a side view of the comb assembly being removed from the blade assembly of the clipper.
Figure 4:
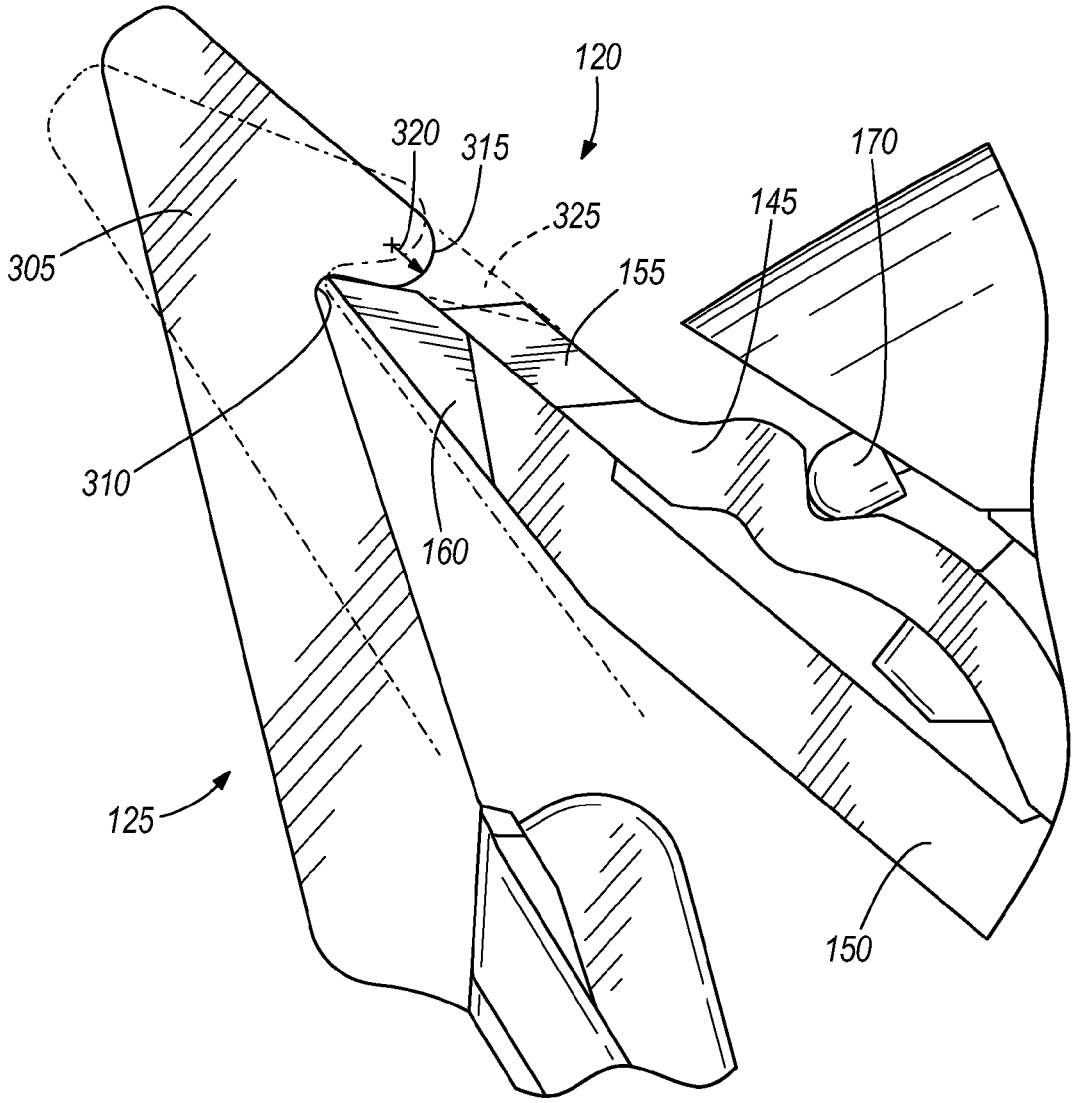
FIG. 4 is an enlarged view of a portion of FIG. 3 showing the position of a free end of the comb assembly with respect to the blade assembly during removal of the comb assembly.

Turning to FIGS. 2-4, the blade assembly 120 includes an upper blade 145 and a lower blade 150. The upper blade 145 includes sharp teeth 155 and the lower blade 150 includes sharp teeth 160. The cutting edge for each of the upper and lower blades 145, 150 is jagged because of the teeth 155, 160 but, for the sake of simplicity in this specification, the cutting edge will be nominally associated with a line defined by the tips of the teeth 155, 160 or a straight line that is the closest fit to the tips of the teeth 155, 160. Thus, an element or direction of movement can be said to be "parallel" or "perpendicular" to the cutting edge if that is true with respect to the line defined by the tips of the teeth 155, 160. The cutting edge of the upper blade 145 is parallel to and rearward of the cutting edge of the lower blade 150. The teeth 155 of the upper blade 145 extend partially over the teeth 160 of the lower blade 150.

The lower blade 150 may, in the illustrated embodiment, be a "10 blade" or a "30 blade," although the concept of the invention can apply to other sizes of blades. Known comb attachments for clippers are sized to fit onto only one size blade, but the comb assembly 125 of the present invention can be adjusted for at least two different sizes of blades.

The lower blade 150 includes a rear edge 165 that is parallel to the cutting edge. The upper blade 145 is biased against the lower blade 150 with a spring 170. A transmission 175 interconnects the output shaft 140 of the motor 135 to the upper blade 145, such that rotation of the output shaft 140 drives reciprocation of the upper blade 145 on the lower blade 150 (i.e., with respect to the lower blade 150) in a direction that is parallel to both cutting edges. The reciprocating movement gives rise to a shearing action between the overlapping portion of the teeth 155, 160 of the upper and lower blades 145, 150, resulting in cutting hair that extends between the teeth 155, 160.

Figure 7:
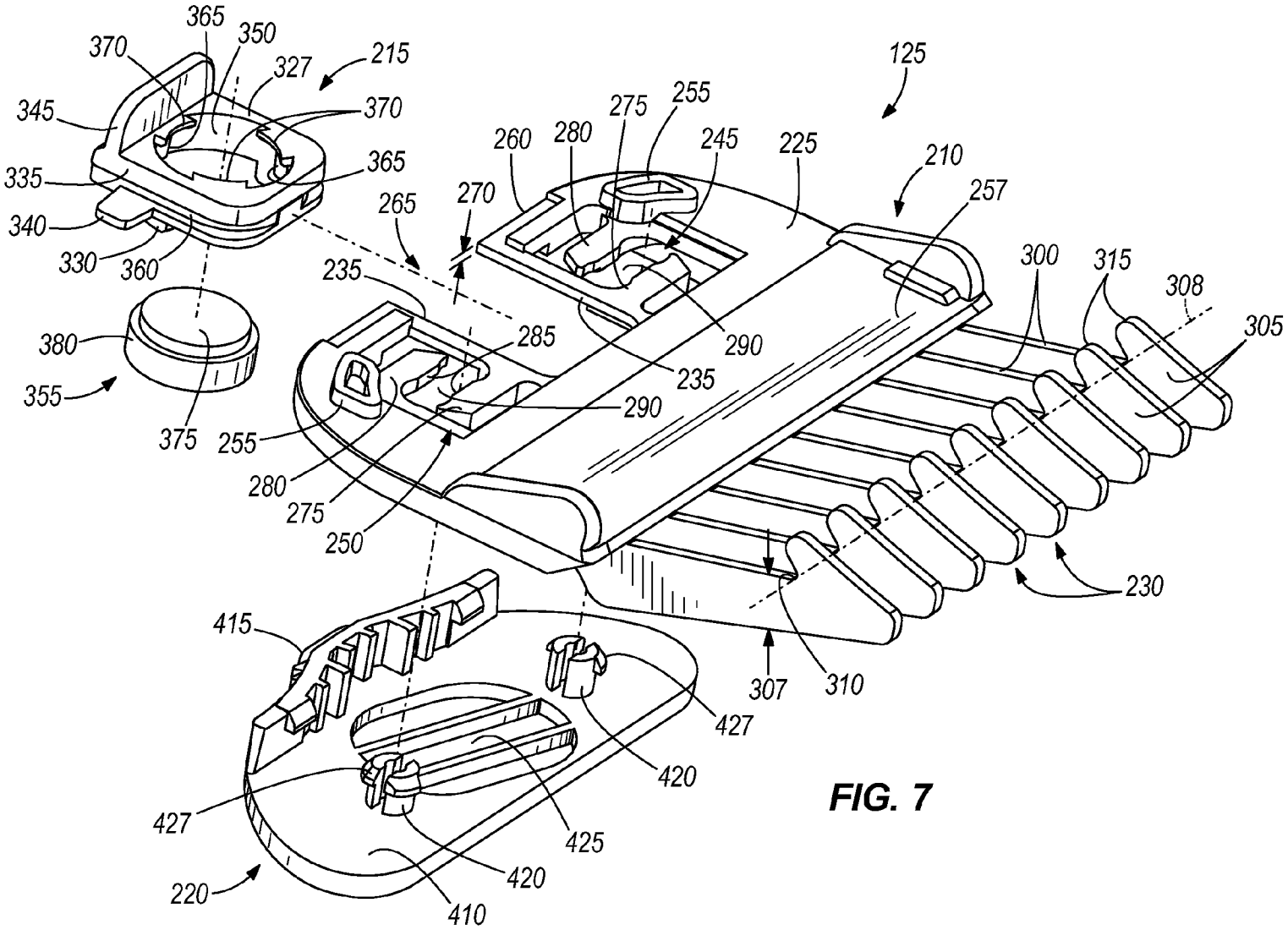
FIG. 7 is a perspective view of the assembled comb assembly.

Referring to FIG. 7, the comb assembly 125 includes a comb attachment 210, a slide module 215, and an adjustment module 220. The comb attachment 210 includes a body 225 and a plurality of tines 230 extending forward from the body 225.

Figure 5:
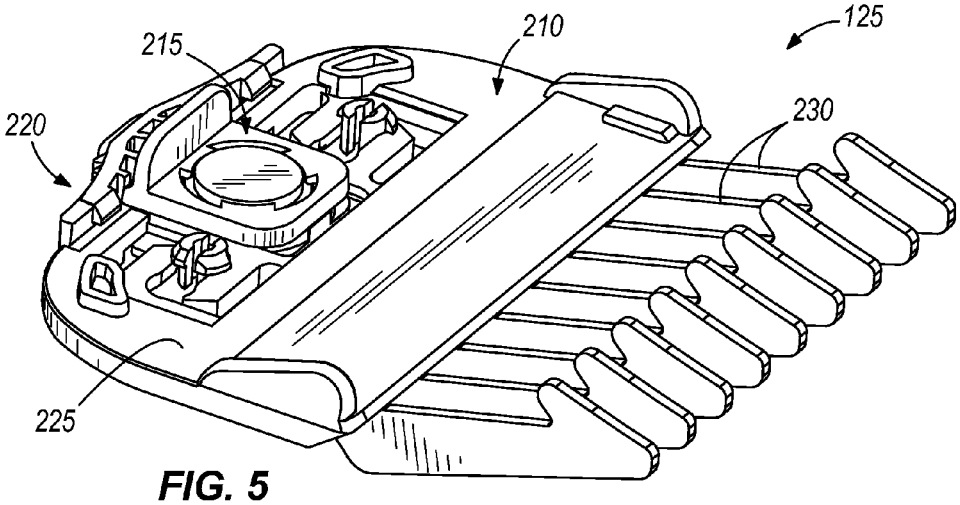
FIG. 5 is an exploded view of the comb assembly.
Figure 6:
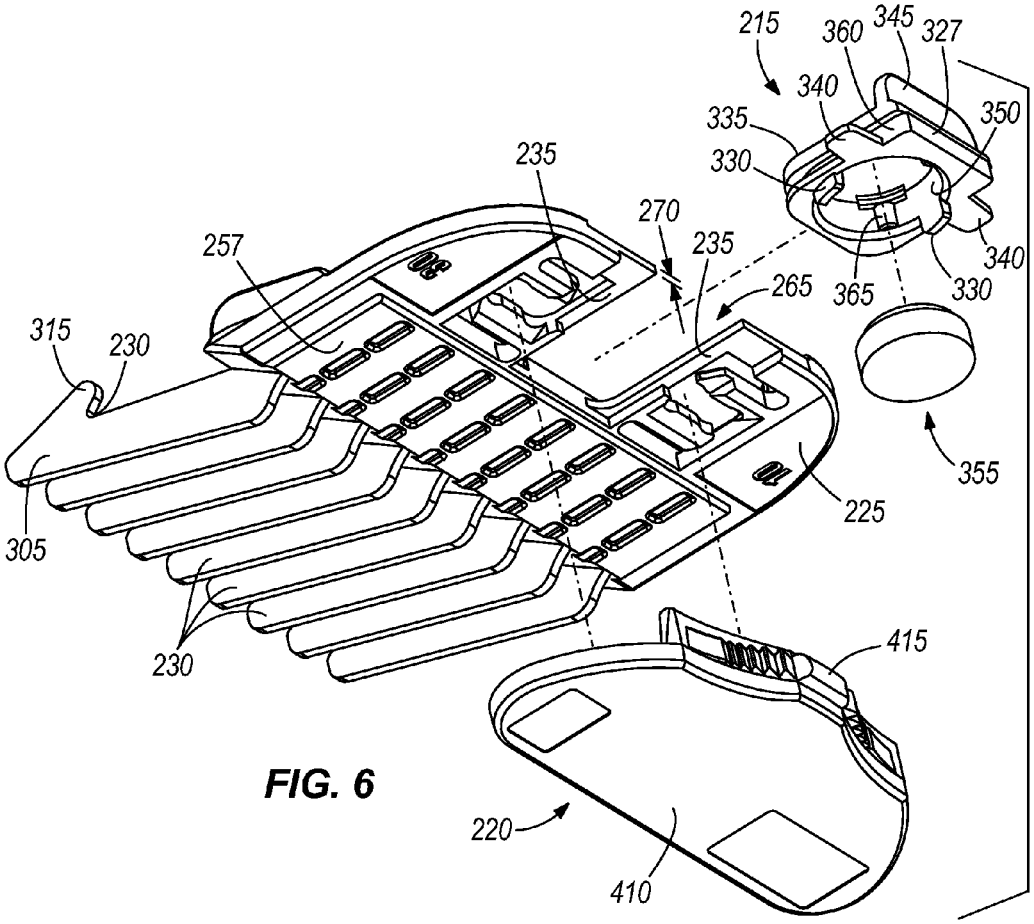
FIG. 6 is an exploded view of the comb assembly from a perspective different from the perspective of FIG. 5.

As illustrated in FIGS. 5 and 6, the body 225 includes a pair of spaced rails 235, a left pair of detent fingers 245, a right pair of detent fingers 250, a pair of stand-off feet 255, and a tine mounting section 257. The rails 235 are formed integrally in the body 225 in the illustrated embodiment, but could be provided separately in other embodiments, and attached to the body 225. The rails 235 extend rearwardly to a rear edge 260 of the comb attachment 210. A slot 265 is defined between the rails 235, the slot 265 being open at the rear edge 260 (i.e., the slot 265 interrupts the rear edge 260). The rails 235 have a reduced thickness 270 compared to the rest of the body 225.

The left pair of detent fingers 245 is a mirror image of the right pair detent fingers 250. Each pair of detent fingers 245, 250 includes a first detent finger 275 that extends in cantilever fashion from the associated rail 235, and a second detent finger 280 that extends in cantilever fashion in an opposite direction from the comb body 225. Each detent finger 275, 280 includes a root and a free end. The detent fingers 275, 280 are parallel to each other and extend in opposite directions, with the free end of one finger 275, 280 being near the root of the other detent finger 275, 280.

Each finger 275, 280 has a curved surface 285 that includes a pair of concave grooves and a separator portion between the concave grooves. The curved surfaces 285 of the detent fingers 275, 280 in each pair 245, 250 face each other, with the concave grooves and separator portions opposite those of the other finger 275, 280. The result is a detent slot 290 between the two curved surfaces 285. The detent slot 290 includes first and second wide sections where concave grooves face each other, and a narrow section where the separator portions face each other. The narrow section of the detent slot 290 separates the first and second wide sections of the detent slot 290 from each other, such that an element must cross the narrow section as it moves from one of the wide sections to the other. In other embodiments, the detent slot 290 may include three or more wide sections divided by narrow sections; this could be accomplished by providing three or more concave grooves and separators on each curved surface 285. The number of wide sections dictates the number of detent positions for the adjustment module 220.

Because of their cantilever arrangement, the detent fingers 275, 280 are deflectable at their free ends to widen the detent slot 290. The detent slot 290 receives a portion of the adjustment module 220, as will be discussed in more detail below. The detent fingers 275, 280 are resilient so they will return to their at-rest position (illustrated) after being deflected by the portion of the adjustment module 220 moving across the narrow portion of the detent slot 290 from one wide section to the other.

The pair of stand-off feet 255 support the lower blade 150 on either side of the sliding module 215, as will be discussed in more detail below.

The tines 230 are attached to the mounting section 257 of the body 225. In the illustrated embodiment, the body 225 is constructed of a hard plastic material and the tines 230 are stainless steel. In other embodiments, different materials can be used for the comb attachment components, and indeed the comb attachment 210 (body 225 and tines 230) can be formed of a single material. The tines 230 include an extension portion 300 that extends forwardly along the bottom side of the lower blade 150, and a hook portion 305 that curves rearwardly around the cutting edge and top surface of the lower blade 150. The depth 307 of the extension portions 300 dictates the length of cut for hair. The bottom edges of the extension portions 300 move along the scalp. Since the teeth 155, 160 of the upper and lower blades 145, 155 sit essentially on top of the extension portions 300, the teeth 155, 160 are spaced from the scalp by the depth 307.

The hook portion 305 includes a pivot surface 310 and a free end 315. The comb attachment 210 pivots on the cutting edge of the lower blade 150 with the pivot surface 310 in contact with the lower blade 150. The pivot surfaces 310 of the plurality of tines 230 align to form an overall segmented pivot surface that engages the cutting edge of the lower blade 150 and defines a pivot line 308 (which is essentially collinear with the cutting edge of the lower blade 150) about which the comb attachment 210 pivots during attachment and removal of the comb attachment 210 from the lower blade 150. When installed on the lower blade 150, the pivot surface 310 of the comb attachment 210 engages the cutting edge of the lower blade 150 to resist rearward movement of the comb attachment 210 with respect to the lower blade 150.

As illustrated in FIG. 4, the free end 315 of the hook portion 305 is rounded with a selected radius 320 that prevents the free end 315 from extending between the teeth 155 of the upper blade 145 (i.e., crossing the upper cutting edge) as the comb attachment 125 is pivoted about the pivot line 308 during installation or removal of the comb attachment.

Known combs have pointed free ends 325 (shown in phantom in FIG. 4). The inventor has discovered that the pointed free ends 325 of the tines in known comb attachments can become damaged when the comb attachment 125 is installed or removed while the upper blade 145 is reciprocating, because the pointed free ends 325 extend between the teeth 155 of the upper blade 145. The maximum distance between the free ends 315 of the tines 230 and the pivot line 308, and between the free ends 315 and the top edge of the tines 230 (which come in contact with the lower blade cutting edge as the comb attachment is installed and removed) is less than the distance between the pivot line 308 (which is essentially collinear with the lower blade cutting edge) and the cutting edge of the upper blade 145.

With reference to FIGS. 5 and 6, the slide module 215 includes a slide body 327 a pair of depending fingers 330 extending down from the bottom of the slide body 327, top flanges 335 on the left and right sides, bottom flanges 340 on the left and right sides, an upwardly extending retaining tab 345, a magnet-receiving aperture 350, and a magnet assembly 355. A smooth guide surface 360 extends between the top flanges 335 and bottom flanges 340 on the right and left sides of the slide body 327. The gap between the top and bottom flanges 335, 340 is slightly larger than the thickness 270 of the rails 235 so that the rails 235 are received between the top and bottom flanges 335, 340 and the slide module 215 slides within the slot 265 in the comb attachment body 225, with the rails 235 against the smooth guide surfaces 360. The slide module 215 is supported for forward and rearward movement on the rails 235 in the slot 265.

As illustrated in FIG. 2, the retaining tab 345 is positioned adjacent the rear edge 165 of the lower blade 150 and engages the rear edge 165 during use of the clipper 110 to resist forward movement of the comb assembly 125 with respect to the lower blade 150.

Referring again to FIGS. 5 and 6, the magnet receiving aperture 350 is a through bore, extending through the slide body 327 from the top to the bottom along a vertical axis. The magnet receiving aperture 350 includes three magnet centering tabs 365 in the lower portion of aperture 350 and three magnet retaining fingers 370 in the upper portion of aperture 350. The magnet centering tabs 365 and magnet retaining fingers 370 are spaced evenly, at 120° intervals around the circumference of the magnet receiving bore 350.

The magnet assembly 355 includes a magnet 375 having a first diameter and a coating or plating 380 around the lower portion of the magnet 375 having a second diameter larger than the first diameter. The magnet 375 is used to magnetically connect the comb assembly 125 to the lower blade 150, and in this regard may be referred to as an example of an attachment mechanism. In other embodiments, the attachment mechanism may not require a magnet. For example the attachment mechanism may include resilient fingers or clips that engage the side edges of the lower blade 150.

The magnet assembly 355 is received within the magnet receiving aperture 350, with the magnet centering tabs 365 engaging the sides of the plating 380 and the magnet retaining fingers 370 extending over the top of the plating 380 and adjacent the sides of the magnet 375. The magnet retaining fingers 370 prevent the magnet assembly 355 from sliding axially out of the top of the slide body 327 because the opening defined by the magnet retaining fingers 370 is smaller than the second diameter (the diameter of the plating 380).

In the illustrated embodiment, the magnet assembly 355 is carried by the slide module 215 and moves forward and rearward as the slide module is moved within the slot 265. In other embodiments, the magnet assembly 355 could be secured elsewhere on the comb assembly 125, in a fixed position and not on the slide module 215.

The adjustment module 220 includes an adjustment plate 410 having a user actuation interface 415, a pair of detent pins 420, and a diagonal slide groove 425. The user actuation interface 415 is rigidly mounted on the rear edge of the adjustment plate 410 and is knurled or ribbed to make it easier for the finger of a user to engage the interface 415 and slide the adjustment plate 410 left and right with respect to the comb attachment body 225. The user actuation interface 415 may be integrally formed with the adjustment plate 410 as, for example, by injection molding, or could be provided separately and rigidly attached to the adjustment plate 410.

The upper surface of the adjustment plate 410 is positioned adjacent the bottom surface of the comb attachment body 225, with the detent pins 420 received in the detent slots 290. The diameter of the detent pins 420 is about equal to the wide sections of the detent slot 290. The free ends of the detent pins 420 may include enlarged diameter portions 427. The enlarged diameter portions 427 have upwardly facing ramped surfaces to facility insertion of the detent pins 420 into the detent slots 290 from below, and downwardly facing shoulder surfaces to resist downward removal of the detent pins 420 from the detent slots 290. Consequently, once the adjustment plate 410 is installed on the comb attachment body 225, the enlarged diameter portions 427 overhang the detent fingers 275, 280 to resist separation of the adjustment plate 410 from the comb attachment body 225.

The detent pins 420 are rigidly mounted to the adjustment plate 410 and may be integrally formed with the adjustment plate 410. The detent pins 420 move right and left as a user slides the adjustment plate 410 right and left by way of the actuation interface 415. The detent pins 420 are strong enough to deflect the detent fingers 275, 280 to spread them away from each other as the detent pins 420 are forced through the narrow section of the detent slot 290 between the first and second wide sections. The detent force, which is the force that must be overcome in order to move the detent pins 420 from one wide section across the narrow section to the other wide section of the detent slots 290, should be high enough to hold the detent pins 420 in place during ordinary operation of the clipper 110, but not so high that the operator has a difficult time shifting the actuation plate 410. It is preferable that the detent mechanism (the pins 420 and the slot 290) provide tactile or auditory or both tactile and auditory feedback to the operator to confirm that the detent mechanism has fully shifted from one position to another.

The diagonal slide groove 425 extends obliquely (neither parallel nor perpendicular) to the cutting edges of upper and lower blades 145, 150. The diagonal slide groove 425 is also oblique to forward and rearward movement of the slide module 215, which in the illustrated embodiment are perpendicular to the cutting edges. The depending fingers 330 of the slide module 215 are received within the diagonal slide groove 425, such that side-to-side (i.e., left and right) movement of the actuation plate 220 causes the slide module 215 to move forward and rearward. The adjustment module 220 may in other embodiments take the form of another mechanism for converting side-to-side or rotational movement of one member into forward and rearward movement of the slide module 215. In some embodiments, the adjustment module may include an element that the operator pushes forward and pulls rearward to move the slide module forward and rearward.

Figure 8:
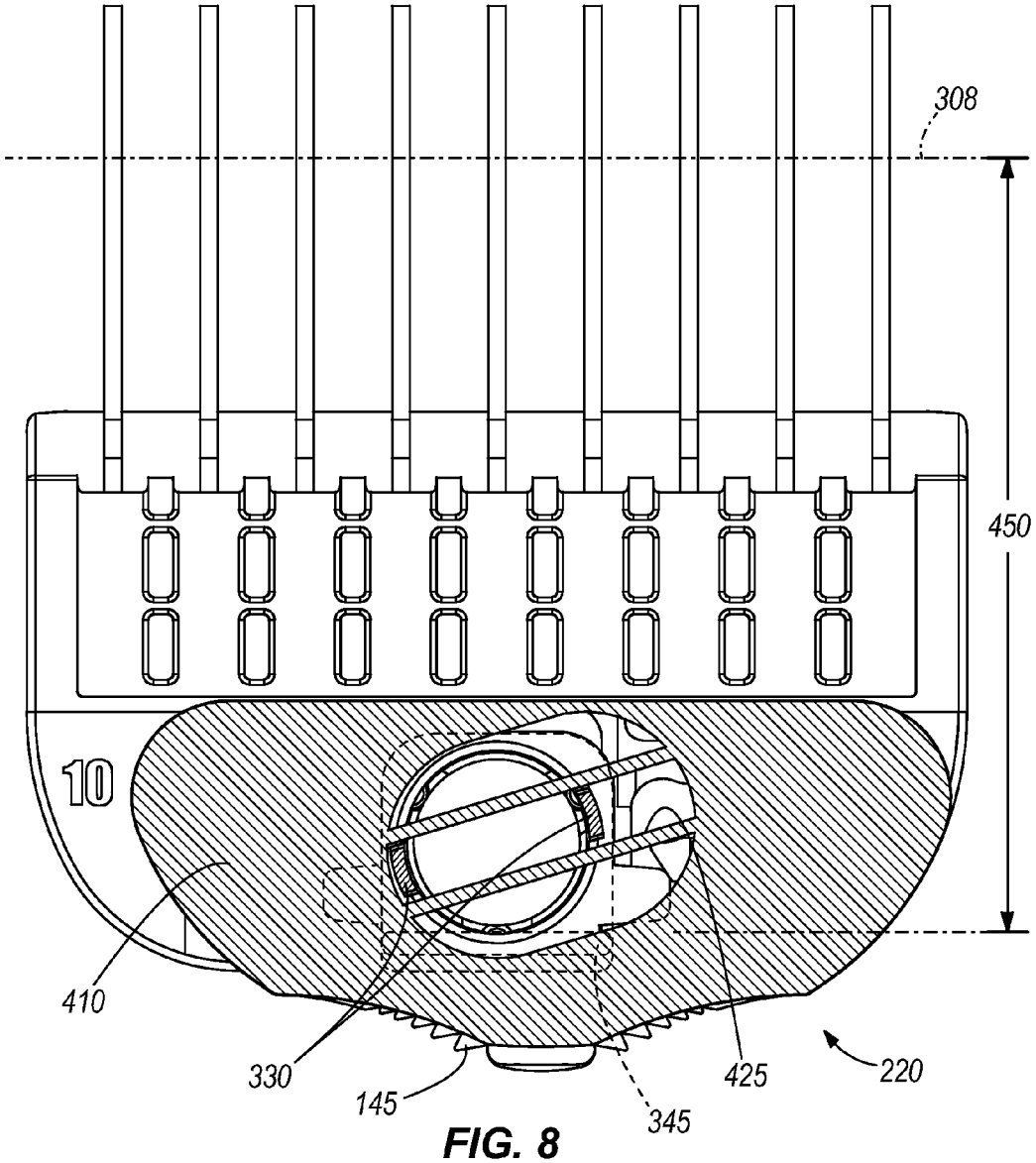
FIG. 8 is a cross-sectional view of the comb assembly with an adjustment mechanism in a first position.
Figure 9:
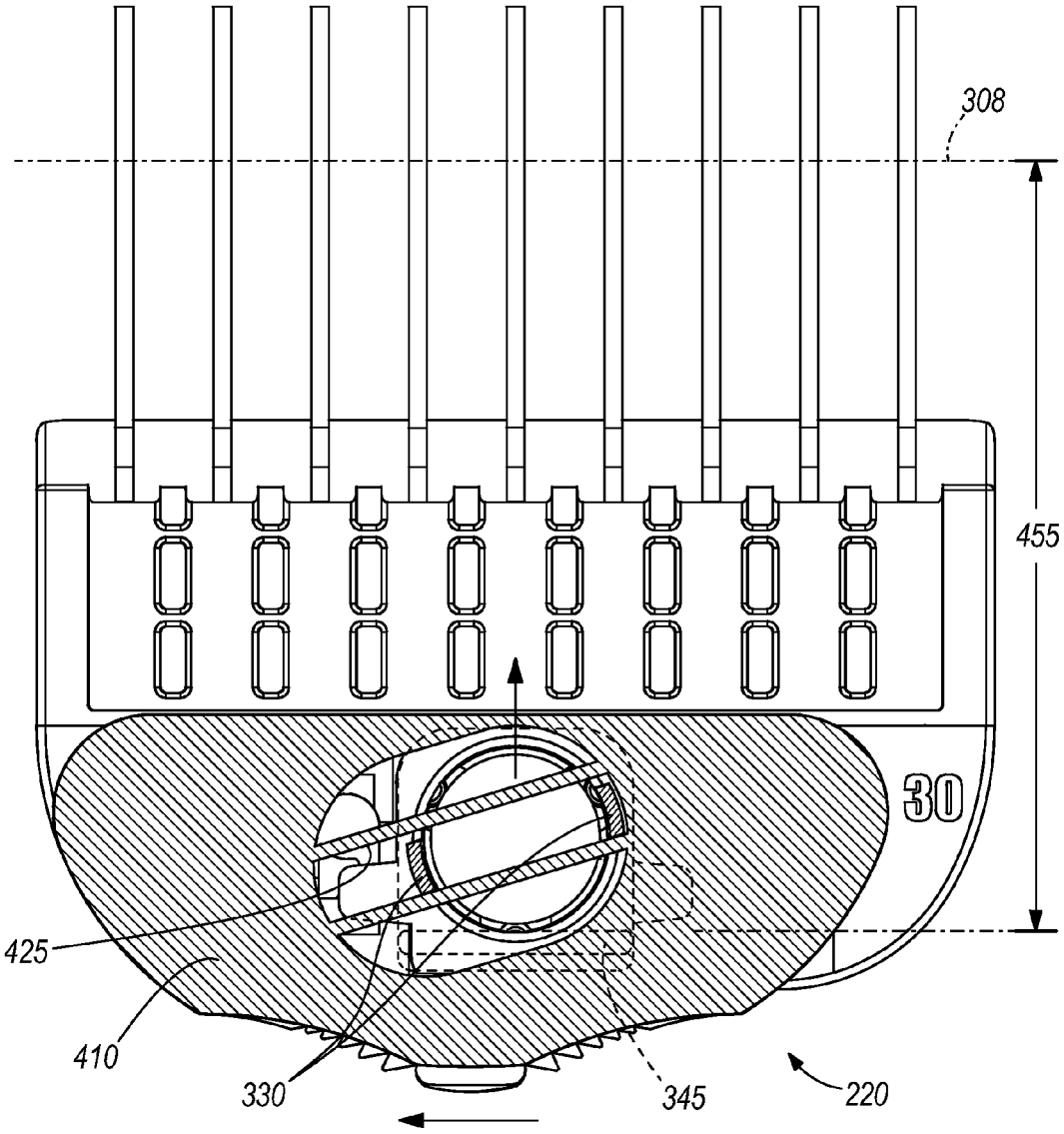
FIG. 9 is a cross-sectional view of the comb assembly with the adjustment mechanism in a second position.
Figure 10:
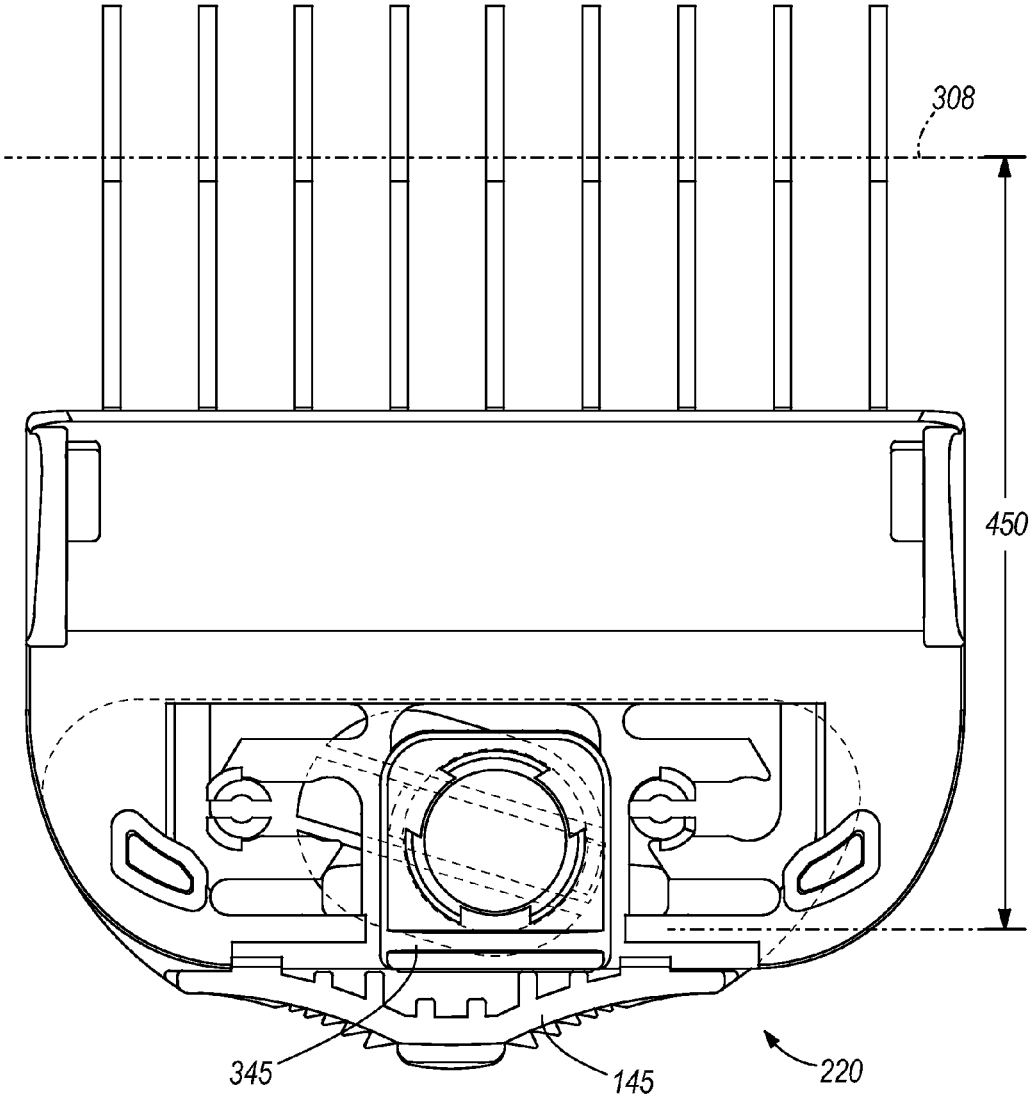
FIG. 10 is a top view of the comb assembly, corresponding to FIG. 8.
Figure 11:
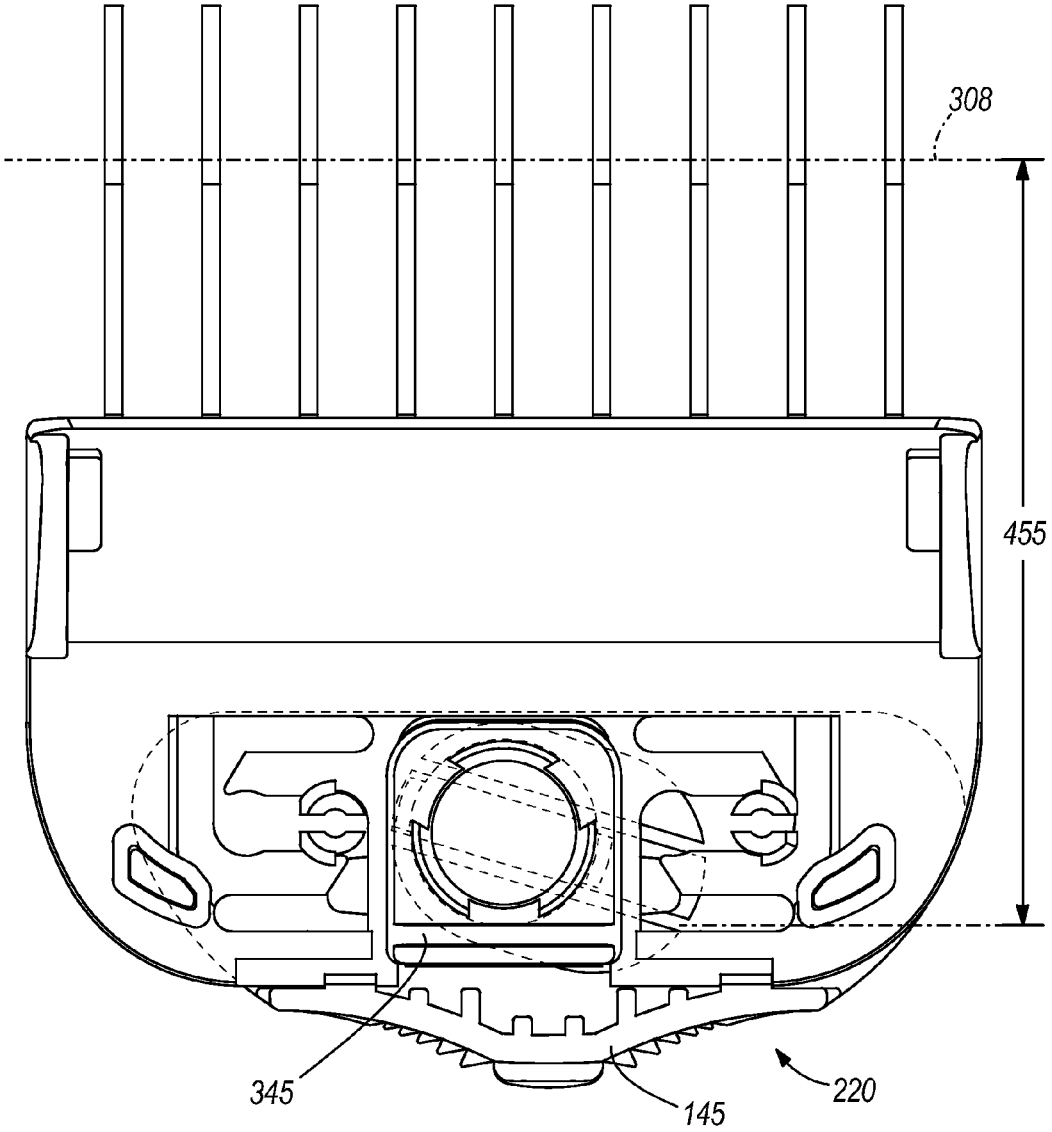
FIG. 11 is a top view of the comb assembly, corresponding to FIG. 9.

With reference to FIGS. 8-11, the comb body 225 includes the numerals "10" and "30" on the bottom surface to the right and left sides. FIGS. 8 and 10 correspond to each other and FIGS. 9 and 11 correspond to each other, but FIGS. 8 and 9 are views from underneath the comb assembly 125 and FIGS. 10 and 11 are views from above the comb assembly 125. With reference to FIGS. 8 and 10, the adjustment plate 410 is movable to the left to cover the numeral "30" and uncover the numeral "10." With reference to FIGS. 9 and 11, the adjustment plate 410 is movable right to cover the numeral "10" and uncover the numeral "30."

Because of engagement of the depending fingers 330 in the oblique slide groove 220, movement of the oblique slide groove 220 to the left urges the slide module 215 rearward, and movement of the oblique slide groove 220 to the right urges the slide module 215 forward. Consequently, when the adjustment plate 410 is moved to the left, the retaining tab 345 is positioned rearward and the numeral "10" is visible, and when the adjustment plate 410 is moved to the right, the retaining tab 345 is positioned forward and the numeral "30" is visible. Each of the left and right positions of the adjustment plate 410 corresponds to the detent pins 420 being received in wide sections of the detent grooves 290.

When the retaining tab 345 is positioned rearward and the numeral "10" is visible, the retaining tab 345 is spaced from the pivot line 308 a distance 450 corresponding to the distance between the cutting edge and rear edge 165 of a 10-blade lower blade 150. When the retaining tab 345 is positioned forward and the numeral "30" is visible, the retaining tab 345 is spaced from the pivot line 308 a distance 455 corresponding to the distance between the cutting edge and rear edge 165 of a 30-blade lower blade 150.

In operation, a blade assembly 120 having a lower blade 150 of a desired size is attached to the clipper 110. The lower blade 150 that is included in the blade assembly 120 and attached to the clipper 110 can be referred to as the active lower blade 150, and another blade of a different size that is not selected can be referred to as the inactive lower blade. The adjustment mechanism 220 is shifted into the position that corresponds to the active lower blade 150. For example, if in the illustrated embodiment, the operator selects a 10-blade as the active lower blade 150 and a 30-blade as the inactive lower blade, the operator shifts the adjustment plate 410 to the left to move the slide module 215 and retaining tab 345 rearward. The "10" will be visible to confirm the setting.

Then the comb assembly 125 is attached to the active lower blade 150 by engaging the teeth 160 of the lower blade 150 with the pivot surface 310 as in FIG. 3, and pivoting the comb assembly 125 about the pivot line 308 into the position illustrated in FIG. 4. The magnet 375 attaches to the active lower blade 150 to resist the comb assembly 125 moving down away from the lower blade 150, and the retaining tab 245 is positioned adjacent the rear edge 165 of the active lower blade 150. The rear portion of the active lower blade 150 seats on the sliding module 215 and the stand-off feet 255 on either side of the slide module 215, to provide a stable seat for the lower blade 150 across the width of the rear portion of the comb body 225. The operator is then ready to clip or trim hair with the clipper 110.

In the event the operator wishes to switch lower blades, the operator removes the comb assembly 125 by pivoting the comb assembly about the pivot surfaces 310, which detaches the magnet 375 from the active lower blade 150. The magnet assembly 355 is retained within the slide body 327 by the magnet centering tabs 365 and magnet retaining fingers 370. As the comb assembly 125 pivots into the disengaged position, the rounded free ends 315 of the tines 230 are kept out of the teeth 155 of the upper blade 145 as discussed above, so even if the upper blade 145 is reciprocating, the free ends 315 will not run the risk of being sheared off by the upper blade 145.

The operator then detaches the blade assembly 120 and swaps the active lower blade 150 for the inactive lower blade (e.g., in the illustrated embodiment, the 30-blade now becomes the active lower blade 150 and the 10-blade is the inactive lower blade) and installs the blade assembly 120 back on the clipper 110. The adjustment mechanism 220 is shifted so the slide module 215 and its tab 345 move forward to accommodate the smaller active lower blade 150, and the comb assembly 125 is installed onto the new active lower blade 150 as described above.

Thus, the invention provides, among other things, a comb attachment having rounded free ends on its tines, such that the free ends of the tines do not cross the cutting edge of the upper blade during attachment and removal of the comb attachment. Various features and advantages of the invention are set forth in the following claims.

What is claimed is:

1. A comb assembly for a hair clipper having a lower blade and an upper blade reciprocating with respect to the lower blade, the lower blade having a lower cutting edge and the upper blade having an upper cutting edge, the upper cutting edge being parallel to and rearward of the lower cutting edge, the comb assembly comprising:

a comb attachment comprising a body and a plurality of tines extending forward from the body; and an attachment mechanism for attaching the comb attachment to the lower blade;

wherein each tine includes an extension portion extending along a bottom side of the lower blade;

wherein each tine includes a hook portion curving from the extension portion across the lower cutting edge;

wherein each hook portion includes a rounded free end adjacent a top surface of the lower blade rearward of the lower cutting edge and forward of the upper cutting edge, the rounded free end describing a radius of curvature;

wherein the comb attachment is pivoted about the lower cutting edge during installation and removal of the comb attachment from the lower blade; and wherein the radius of curvature of the rounded free end of each hook portion is sized to avoid the free end from crossing the upper cutting edge as the comb attachment is pivoted on the lower cutting edge during installation and removal of the comb attachment.

2. The comb attachment of claim 1, wherein the attachment mechanism includes a magnet carried by the body, and engageable with the lower blade through a magnetic attraction.

3. A hair clipper comprising:

a prime mover;

a lower blade having a lower cutting edge;

an upper blade reciprocating with respect to the lower blade under the influence of the motor, the upper blade having an upper cutting edge that is parallel to and rearward of the lower cutting edge;

a comb attachment comprising a body and a plurality of tines extending forward from the body; and an attachment mechanism for attaching the comb attachment to the lower blade;

wherein each tine includes an extension portion extending along a bottom side of the lower blade;

wherein each tine includes a hook portion curving from the extension portion across the lower cutting edge;

wherein each hook portion includes a rounded free end adjacent a top surface of the lower blade rearward of the lower cutting edge and forward of the upper cutting edge, the rounded free end describing a radius of curvature;

wherein the comb attachment is pivoted about the lower cutting edge during installation and removal of the comb attachment from the lower blade; and wherein the radius of curvature of the rounded free end of each hook portion is sized to avoid the free end from crossing the upper cutting edge as the comb attachment is pivoted on the lower cutting edge during installation and removal of the comb attachment.

4. The hair clipper of claim 3, wherein the attachment mechanism includes a magnet carried by the body of the comb attachment.

5. The comb attachment of claim 1, wherein a maximum distance between the free ends of the tines and a pivot line, and between the free ends of the tines and a top edge of the tines is less than the distance between the pivot and the upper cutting edge.

6. The comb attachment of claim 1, wherein the top edge of the tines contact the lower cutting edge as the comb attachment is installed and removed.

7. The comb attachment of claim 1, wherein a pivot line is substantially collinear with the lower cutting edge.

* * * * *